US005787837A

United States Patent [19]

Vavolotis

[11] Patent Number: 5,787,837

[45] Date of Patent: Aug. 4, 1998

[54] MOVABLE HIKING BENCH

[76] Inventor: Andrew C. Vavolotis, 3 Assawompsett Ct., Lakeville, Mass. 02347

[21] Appl. No.: 730,749

[22] Filed: Oct. 15, 1996

[51] Int. Cl.[6] ..... B63B 17/00

[52] U.S. Cl. ..... 114/363; 114/39.001

[58] Field of Search ..... 114/39.1, 61, 343, 114/347, 363, 364

[56] References Cited

U.S. PATENT DOCUMENTS

| | | | |
|---|---|---|---|
| 3,718,365 | 2/1973 | Gibson . | |
| 4,766,838 | 8/1988 | Johnson . | |
| 4,773,709 | 9/1988 | Slinkard | 114/363 |
| 4,986,202 | 1/1991 | Mourgue et al. | 114/363 |
| 5,377,607 | 1/1995 | Ross . | |

FOREIGN PATENT DOCUMENTS

| | | | |
|---|---|---|---|
| 960061 | 4/1950 | France | 114/363 |
| WO 90/08062 | 7/1990 | WIPO | 114/363 |

*Primary Examiner*—Ed L. Swinehart

*Attorney, Agent, or Firm*—Chris A. Caseiro; Thomas L. Bohan

[57] ABSTRACT

A device designed to enable a sailor to move easily about a watercraft. The device includes a bench unit that may extend substantially from port to starboard. One or more bench units are movingly coupled to a rail system extending fore and aft on the watercraft. The bench unit is designed and coupled to the rail system such that the sailor can remain on the bench unit and move it fore and aft by pushing his or her feet on the underlying substrate above which the sailor sits. The bench unit is preferably designed to permit the sailor to straddle it. The bench unit may be a unitary piece extending substantially the entire width of the watercraft. Alternatively, it may be formed of two sections that can be moved independent of one another. A handrail affixed to the bench enhances stability for the sailor. An optional braking system that can be engaged or disengaged by the sailor prevents undesired movement of the bench unit along the rails.

18 Claims, 3 Drawing Sheets

MOVABLE HIKING BENCH

BACKGROUND OF THE INVENTION

1. Field of the Invention

The present invention is related to devices for moving around watercraft. More particularly, the present invention is related to benches or seats affixable to watercraft and designed to make movement around the watercraft easier. Still more particularly, the present invention is related to hiking benches or seats affixable to sailing watercraft, including mono-, and multi-hull watercraft.

2. Description of the Prior Art

Sailing has been, and continues to be, a recreational and commercial endeavor of great interest throughout the world. It is, however, a significant undertaking, requiring considerable concentration and physical exertion in order to properly control the craft. This is particularly so when the sailing vessel is operated by a lone individual. The strain of concentration and physical effort can be exhausting, either lessening the pleasure of sailing, reducing the amount of time spent sailing, or a combination of the two.

The strain associated with sailing can be even greater in mull-hull craft-e.g., catamarans and trimarans. As is well known to individuals who sail such craft, they are commonly designed with two or more separate hull sections linked together by a very lightweight support component. This support component is essentially made of a soft, flexible material of the type generally used in making trampolines. This material has considerable "give," and is difficult to move about on. Unfortunately, this trampoline between the hulls makes movement about the vessel a time consuming and physically difficult task. Moreover, when the craft is moving at high speeds, the lack of surefootedness associated with the trampoline material renders operation of the craft somewhat hazardous.

Another disadvantage associated with the trampoline is the required positioning of the sailor on the trampoline. The sailor must sit with his or her feet outstretched, making it awkward and difficult to move from one position to another. Not only is this an awkward position to be in for an extended period of time, it also subjects the sailor to sitting on a surface that is, for the most part, wet. A further disadvantage with the trampoline is that it is an energy-absorptive material. That is, when the sailor moves on the craft port and starboard and fore and aft in order to trim it, part of the trimming comes from the transfer of the sailor's weight to the structural components of the craft. The absorptive characteristic of the trampoline reduces and/or delays that weight transfer, thereby causing a delay in the trimming of the craft, or at least a reduction in the effectiveness of the weight transfer.

Several devices have been made available to ease the effort required to move about multi-hull and/or high speed, small-hull craft. Specifically, trapezes have been attached to such craft. The trapeze is affixed to the upper section of the mast and is designed to permit the sailor seated on it to swing out beyond the port and starboard limits of the craft in order to increase the righting moment in higher winds. However, it is also a relatively dangerous procedure, particularly at high speeds, where a pitching of the boat may cause the sailor to lose the capability to right the craft. In addition, considerable physical strength and expertise is required in order to operate the trapeze successfully. This need for such skill is of particular importance when the sailor seeks to come about. In that situation, it is necessary to come off the trapeze, disconnect it from the side of the craft it is connected to, walk across the trampoline, and re-connect it so as to get outboard on the other side. It is well known to those skilled in this field that coming about is an important procedure. The process described for re-configuring the trapeze is relatively time consuming and does require movement across the trampoline—an unsteady endeavor, particularly at high speeds, in gusty winds, and in rough seas. As a result, the trapeze is a less-than-optimum means for trimming the craft, both fore and aft and port and starboard. It is also a difficult task, again, particularly at high speeds. Thus, except for the most expertly skilled and most physically fit, most sailors are unlikely to find the trapeze's benefits outweigh its deficiencies.

An alternative device that is available and that may be used for multi-hull craft but that is specifically designed for small craft is a stationary rack that extends out beyond the port and starboard sides of the craft. The rack is designed somewhat like an outrigger in that it extends outboard; however, it also includes a seat on which the sailor sits. Unfortunately, the device is fixed in place and therefore does not aid the sailor in moving fore and aft to level the craft and, therefore, it has limited applicability in sailing.

Other devices have been described for the purpose of making movement about a watercraft easier. These devices have not been specifically directed to sailing craft, they do, however, provide an indication of the need for less hazardous and less physically tiring means for moving about and controlling a vessel. U.S. Pat. No. 3,718,365 issued to Gibson describes a slidable seat that can be moved on rails running port and starboard on a boat. The rails are designed to be fixed in place, although they can be adjusted to different positions on the gunwales of the boat. This device fails to address the needs associated with the piloting of a sailing craft, where relatively rapid movement around the entire craft—including fore and aft—is important. Since the rails are essentially fixed in place, it is not possible to quickly move the Gibson device fore and aft. U.S. Pat. Nos. 4,765,838 and 4,709,648 issued to Johnson and Andrews, respectively, teach similar types of sliding seats. As with the Gibson device, these sliding seats fail to provide easy movement in the fore and aft directions.

U.S. Pat. No. 5,377,607 issued to Ross describes a sailboard with components that permit the board to be converted between sailing, paddling, and rowing types. The craft includes a movable multi-function seat. A limitation of the Ross craft that is critical to the discussion of the present invention as it relates to multi-hull and high-speed monohull craft is the board itself. The Ross board is, effectively, a wide monohull having add-on components that can not be applied to multi-hull and high speed craft. These components are necessary for the Ross design in order to permit conversion from one type of craft to another. Further, when the Ross device is set up as a sailing craft, the bench seat is apparently fixed in place by pins so as to prevent movement of the seat, either port and starboard or fore and aft.

In summary, there does not presently exist a system for aiding in the safe, complete, and efficient movement of a sailor about a sailing craft. Therefore, what is needed is a safe and efficient device designed to permit a sailor to move fore and aft and port and starboard on a sailing craft. What is needed is a device that permits rapid and easy hiking in and out on the craft than is achievable by moving on a trampoline alone. What is also needed is a hiking device that couples the sailor's weight directly to the structural components of the craft, rather than coupling that weight through the energy-absorbing trampoline. Further, what is needed is a device that provides a comfortable position while sailing, rather than the uncomfortable, and usually wet, position associated with sitting on a trampoline. Still further, what is needed is such a device that is adaptable to monohull and multi-hull craft. Yet further, what is needed is a device that includes a direct and secure coupling of the sailor to the craft, particularly in high winds and/or rough seas.

SUMMARY OF THE INVENTION

It is an object of the present invention to provide a safe and efficient device designed to permit a sailor to move fore and aft and port and starboard on a sailing craft. It is another object of the present invention to provide a device that permits rapid and easy hiking in and out on the craft than is achievable by moving on a trampoline alone. It is still another object to provide a hiking device that couples the sailor's weight directly to the structural components of the craft, rather than coupling that weight through the energy-absorbing trampoline. It is yet another object of the present invention to provide a device that provides a comfortable position while sailing, rather than the uncomfortable, and usually wet, position associated with sitting on a trampoline. Further, it is an object to provide such a device that is adaptable to monohull and multi-hull craft. Yet further, it is an object of the present invention to provide such a device that includes a direct and secure coupling of the sailor to the craft, particularly in high winds and/or rough seas.

These and other objectives are achieved in the present invention by the combination of a hiking bench and a rail system to which the hiking bench is coupled. The hiking bench is designed to extend substantially the complete width of the craft, and may extend beyond that width to increase the sailor's ability to trim the craft. That is, it extends effectively from the left (port) to the right (starboard) of the watercraft, regardless of the specific type of hull. The hiking bench may extend less than the full width of the craft; however, that would reduce the effective range of movement available to the sailor.

The hiking bench preferably includes some means for preventing the sailor from moving beyond the bench's outer limits. A lip, a curved seat, or other type of bench end stop at opposing ends of the bench is suitable for that purpose. The hiking bench may be further modified so as to increase its usefulness by making it extendable in some way. That is, the actual length of the bench may be approximately the same as the width of the craft, but with retractable wings that can be extended by the sailor when in an outboard position on the port or starboard side of the craft. Each end of the bench may have such a wing, which may simply be a slidable bench end held in place by some type of tension means, such as a bungee cord. Alternatively, for a single bench unit, the bench may be coupled to the rail system so that it slidingly or rollingly can be moved port and starboard. In that way, extendable wings could be used, but would not be necessary to move the sailor beyond the width of the craft. An extendable bench system would be useful for all types of craft, including monohull craft. For those types of watercraft, which experience more significant heeling, it is desirable to avoid the use of permanently fixed wings that can extend far enough beyond the hull width so as to contact the water and thereby affect trimming efforts. For a split bench having independently operable units of the type to be described herein, the outboard ends of the bench units could be extendable. Alternatively, the bench unit can be coupled to slidingly or rollingly move in relation to the rails.

An important safety component of the present invention is the application of a handrail affixed to, and extending substantially the entire length of the bench. The handrail aids the sailor in moving from one position to another as he or she slides along the bench between the port and starboard areas of the craft. It also provides a secure means of connecting the sailor directly to the watercraft, especially during high speeds in gusty winds and/or rough seas.

As indicated in the discussion of the positioning of the hiking bench, the bench provides the sailor with a complete range of motion port and starboard on the craft. The rail system provides for a complete range of motion fore and aft of the craft. The rail system includes at least two fixed rails, one running along a portion of the outermost port gunwale, and the other running along a portion of the outermost starboard gunwale. The rail system can easily be adapted to monohull as well as multi-hull craft by simple placement in the gunwale locations noted. Moreover, a plurality of hiking benches may be coupled to one or more sets of rails so as to increase the number of rolling hiking benches available for use.

The hiking bench is linked to the rail system by coupling means that permit easy movement of the bench thereon. Although that coupling means may be any type of component that permits the bench to move, including, but not limited to, a rail captured within a channel, a bar within a tube, etc., it is preferably a pair of rollers for each rail, wherein the rail may be a tube. The rollers are pivotably placed around the rail such that the rail is captured therein. A housing for the rollers is affixed to the underside of the bench so that when the sailor pushes on the hull, floor, or trampoline of the craft, the rollers move the bench on the rails. The rails may be made of any suitable material, including, but not limited to, a non-metallic material such as fiberglass, or a metal material, such as Aluminum.

In an alternative design of the bench, it may be split into two sections—a port section and a starboard section, each with its own optional handrail and with its own pair of rollers. This design is particularly suitable for application to trimarans, which have a primary center hull and port and starboard outer floats that are effective outer hulls. This design permits the sailor to move along and/or access the center hull fore and aft without the bench in the way.

An additional optional safety component of the present invention is a braking system that is easily accessed by the sailor so as to prevent undesired fore and aft movement of the bench. This is particularly useful in rough seas wherein motion of the craft may be great enough to cause fore and aft movement of the bench—even with the sailor sitting on it. This braking system may be relatively simple or relatively complex as a function of the need to access it quickly. In one embodiment of the invention, the braking system may simply be a spring-loaded blocking arm that can be swung into place so as to prevent translational movement of the rollers within their housing.

In operation, the combination of the hiking bench and the rail system permits the sailor to easily and quickly reach all important areas of the craft much more safely and with much less physical exertion than is presently required. Each of the rails is attached to the noted gunwales and extends slightly above those gunwales. The bench that is coupled to the rails in the manner noted may be sized as desired. However, it is preferably only wide enough for the sailor to sit on and place one leg on either side of it. Further, it may be varied in height, but should not be so far above the trampoline or hull below that the sailor is unable to comfortably rest his or her feet on that trampoline or hull. Instead, the positioning of the bench permits the sailor to sit comfortably above the surface of the trampoline with knees bent, thus avoiding the awkward sitting position associated with the trampoline. It also provides a relatively dry seat.

The bench provides a means for the sailor to move port and starboard without the need to walk on the unsteady surface below, simply by pushing on that underlying surface while remaining steadily balanced, seated on the bench. The rail system similarly provides the sailor with the capability to move fore and aft, but, again, with balance. In that situation, the sailor does not move himself or herself while the bench remains stationary. Instead, the entire bench—and the sailor along with it—moves fore and aft as the sailor moves it fore and aft along the stationary rails by pushing his or her feet on the underlying surface.

The design of the rolling hiking bench of the present invention provides the optimum righting moment that is not available with present sail craft designs. This capability permits the sailor to shift his or her weight inboard or outboard on the hiking board while simultaneously permitting the sailor to shift his or her body weight fore and aft in order to optimize boat trim, and thereby to optimize boat speed. This capability is achieved with a simultaneous reduction in the physical strain on the sailor.

Supplemental components that may easily be incorporated into the principal components include the introduction of movable ballast coupled to the bench, a sliding seat that may have a comfortable backrest and that may be detachably affixed to the bench, and any other attachments that a sailor may deem useful in increasing the efficiency of operating the craft.

These and other advantages will become apparent upon review of the following detailed description of the invention, the accompanying drawings, and the appended claims.

DETAILED DESCRIPTION OF THE PREFERRED EMBODIMENTS OF THE INVENTION

Figure 1:
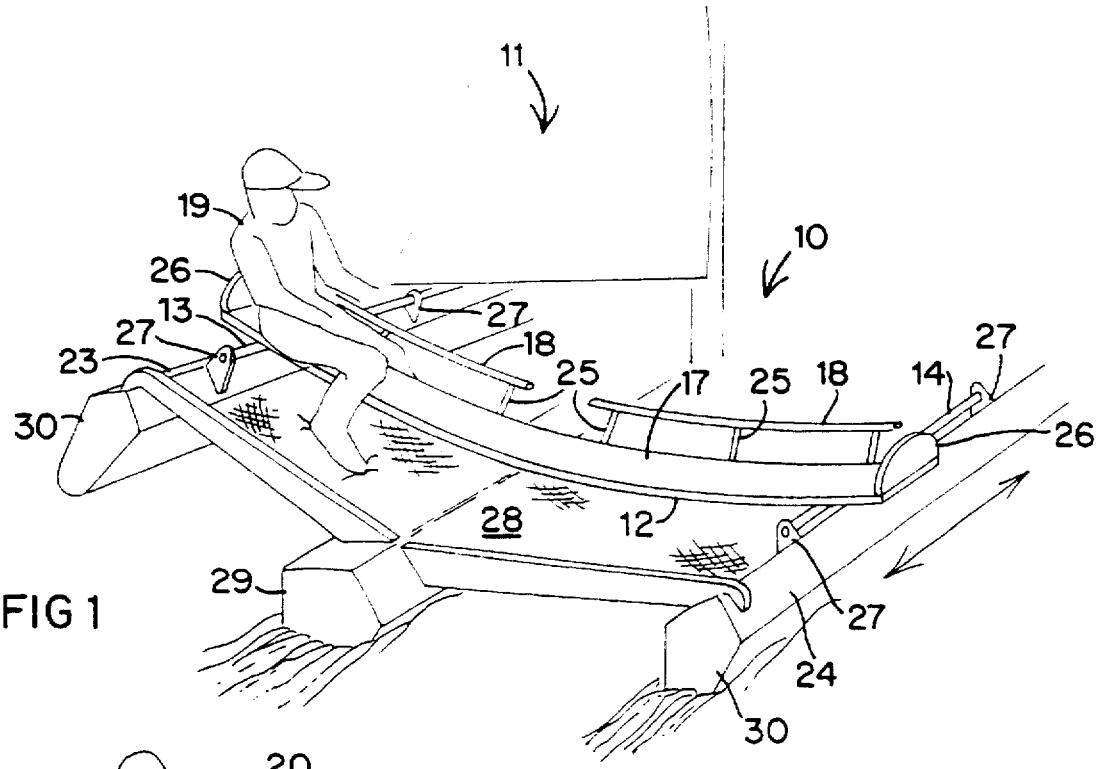
FIG. 1 is perspective view of the movable hiking bench of the present invention coupled to a trimaran.
Figure 2:
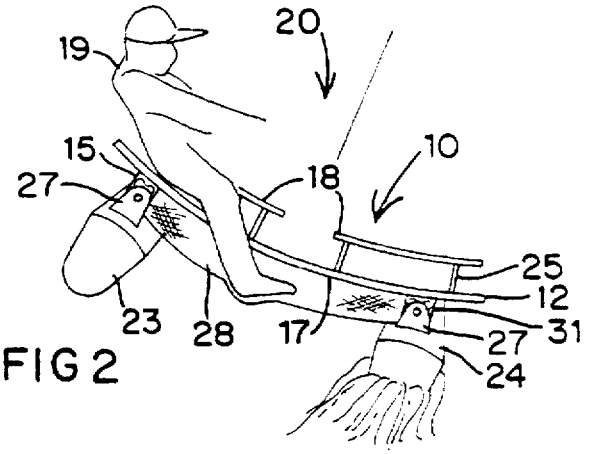
FIG. 2 is a rear view of the movable hiking bench of the present invention coupled to a catamaran.
Figure 4:
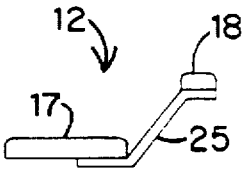
FIG. 4 is a cross-sectional view of the movable hiking bench of the present invention, showing the optional security handrail coupled thereto.
Figure 3:
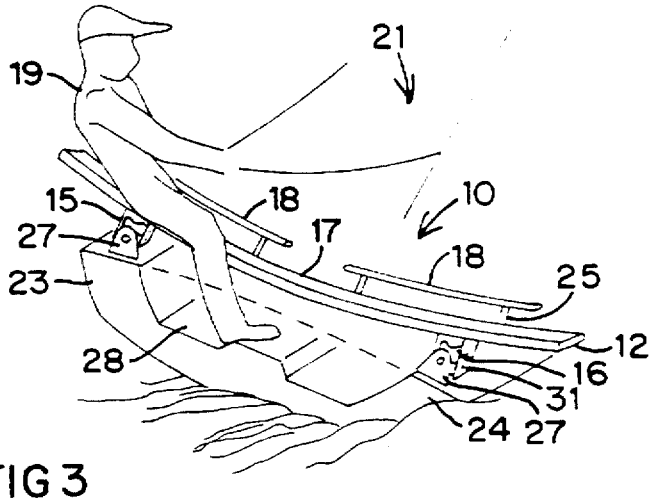
FIG. 3 is a rear view of the movable hiking bench of the present invention coupled to a monohull watercraft.

A movable hiking bench system 10 of the present invention is shown in FIGS. 1–3 alternatively coupled to three types of watercraft. The system 10 shown in FIG. 1 is coupled to a trimaran sailboat 11 and includes as its principal components a hiking bench unit 12 and a pair of bench rails 13, 14. The bench unit 12 is coupled to a port bench rail 13 and a starboard bench rail 14, respectively, by movable coupling means shown in subsequent figures as rollers 15, 16. As illustrated in FIG. 4, the bench unit 12 includes a seat bench 17 and a set of handrails 18 that a sailor 19 may use for balance as he or she slidingly moves along the bench seat 17. The handrails 18 also provide a direct connection of the sailor 19 to the watercraft. This is of particular importance at high speeds, in rough seas, and/or gusty wind conditions. The handrails 18 are coupled to the bench seat 17 by means of a set of coupling bars 25 that may be fabricated of a material similar to that used to make handrails 18.

The bench rails 13, 14, are preferably positioned a few inches above port and starboard gunwales 22, 23, respectively, such that the bench seat 17 is raised above an underlying substrate 28 sufficient for the sailor 19 to rest his or her feet comfortably on that substrate 28. Depending upon the type of watercraft, that substrate 28 may be a hull or a trampoline. For the trimaran 11, the hull may be a center hull 29, or an outer float hull 30.

The bench unit 12 may be fabricated of any material suitable for the intended purpose, including, but not limited to, wood, fiberglass or other non-metallic material, or a relatively lightweight metal such as Aluminum. When the bench unit 12 is a single piece running substantially the entire width—or more—of the watercraft, it is preferably formed with some curvature, as shown in the drawings, so as to conform, to an extent, to the contour of the underlying surface. For one or more bench units 12 that do not extend a considerable portion of the width of the watercraft, curvature is not necessary.

Figure 6:
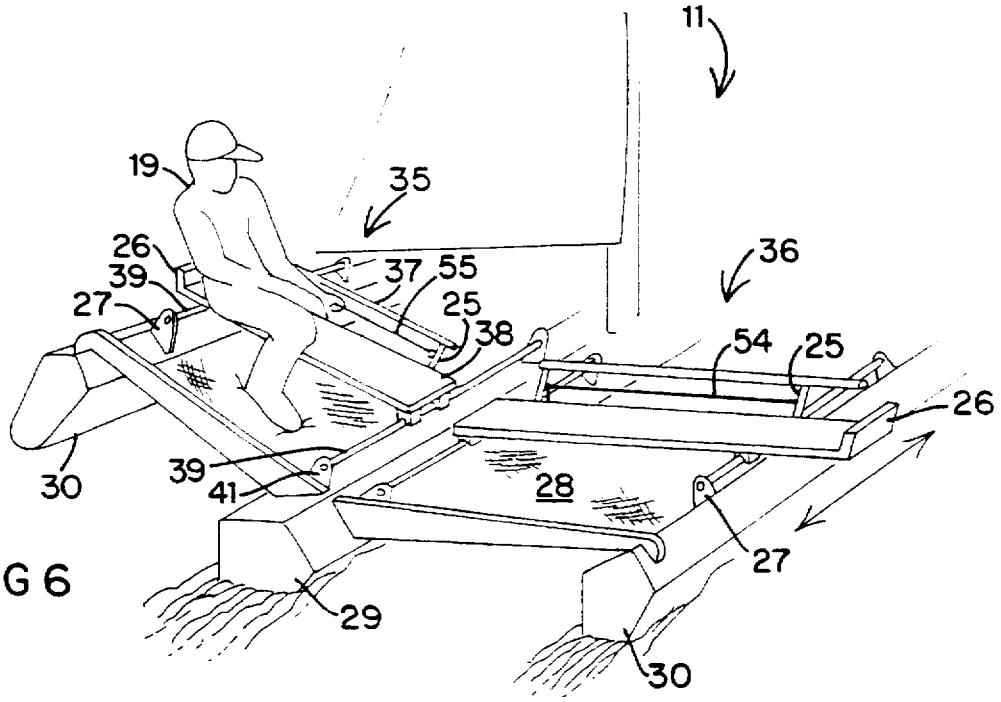
FIG. 6 is a perspective view of an alternative design of the hiking bench of the present invention as a split pair of benches affixed to a trimaran.

A set of optional curved seats 26 located at the port and starboard ends, respectively, of the bench seat 17 enhance the security of the system 10 by acting as a bench end stop. Another type of bench end stop is illustrated in FIG. 6. The curved seat 26 can act as a signal to the sailor 19 that he or she has reached the end of the bench seat 17. It can also stop the sailor 19 from falling from the bench unit 12 in the event of any sudden shift of the craft.

As illustrated in FIGS. 2 and 3, the bench system 10 of the present invention is readily adaptable to other types of sailing craft, including, but not limited to a catamaran sailboat 20 or a monohull sailboat 21. The system 10 is applied to such craft in essentially the same way as it is for the trimaran 11. That is, the port rail 13 and the starboard rail 14 are each affixed to the port gunwale 22 and the starboard gunwale 23, respectively, of the particular watercraft. The rails 13, 14, are preferably made of Aluminum tubing affixed to stanchions 27; however, any other material suitable for the intended purpose may be used. The rails 13, 14 are affixed to the gunwales 22, 23 at two or more positions such that they extend fore and aft of the watercraft. Although it is possible to have the rails 13, 14 extend substantially the entire length of the craft, it is preferable to have them extend only a portion of that length–approximately to the sailboat's mast. That portion must be sufficient to permit the sailor 19 to reach those areas of the craft necessary for its control.

Figure 5:
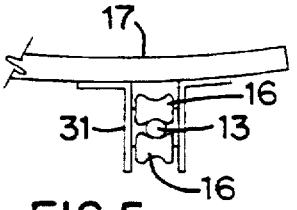
FIG. 5 is a side view of a portion of the movable hiking bench of the present invention, showing the means for moving the bench along one of the stationary rails, where that means for moving the bench is a pair of rollers affixed to the bench and capturing the stationary rail.

A key feature of the present invention is the coupling of the bench unit 10 to the stationary port and starboard rails 13, 14. A variety of coupling means may be employed to ensure that the two components remain joined together while permitting sliding movement of the bench unit 10 fore and aft on the rails 13, 14. A preferred embodiment of the invention employs the sets of pairs of rollers 15, 16 shown in FIGS. 2, 3 and 5. For each rail 13 or 14, there is one or more roller housings 31 having an upper section securely affixed to an underside of the bench seat 17. Of course, it can easily be seen that a plurality of bench units 10 may be coupled to a set of rails so as to provide easier and greater access for trimming of the boat by one or more individuals.

The housings 31 of the preferred embodiment of the present invention capture the rollers 15 or 16 therein, but allow them to pivot, to an extent, around the rails 13 and 14. This permissible pivoting reduces the strain of the twisting experienced in that region as the sailboat moves side to side. It also reduces the amount of swing imparted to the sailor 19. In operation, the coupling of the rollers 13, 14 to the bench seat 17 permit the sailor to push the system 10 fore and aft as he or she pushes his or her feet on the underlying substrate 28, regardless of whether it is a hull or a trampoline.

Figure 7:
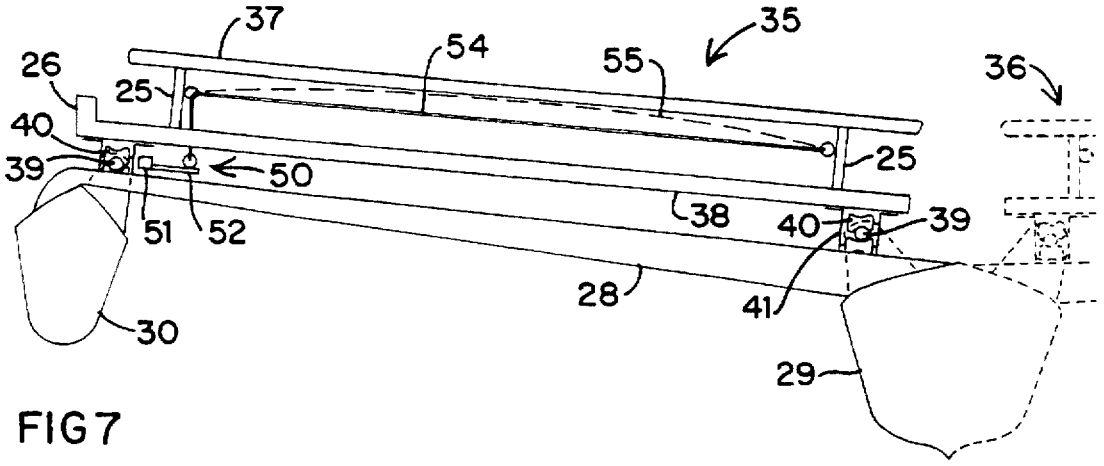
FIG. 7 is an end view showing a portion of the alternative design of the hiking bench of the present invention as a split pair of benches affixed to a trimaran.

In an alternative design of the present invention shown in FIGS. 6–7, the bench system 10 that extends substantially the entire width of the sailboat is formed of two separate bench sections, a port bench section 35 (shown) and a starboard bench section 36 (shown partially in phantom in FIG. 7). This design is particularly suitable for application to the trimaran 11, which has a relatively wide design in comparison to other types of sailboats. This alternative design permits the sailor 19 to access the center hull 29 fore and aft in that that area is left open. It also permits independent operation of those sections on the watercraft, such that, for example, one person may control one bench section for one purpose while another person may operate the other section for a different purpose. The port section 35 includes a port handrail 37, a port bench seat 38, with bench end stop 26, and a set of port rails 39 with their own port roller units 40. The starboard bench section 36 is set up in the same manner, and both sections are coupled and operate in the same manner as the single bench unit 12 previously described, except that center hull stanchions 41 couple the port rail 39 to the center hull 29 rather than to outer gunwales. As can be seen from these drawings, the bench units 35, 36, are straight, rather than curved, as the regions of the craft 11 that they cover are relatively straight.

Figure 8:
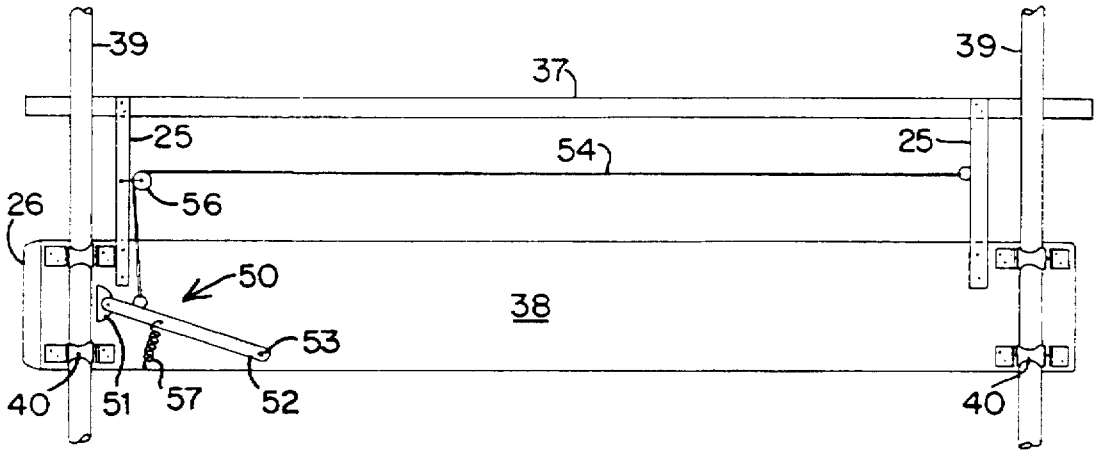
FIG. 8 is a bottom view showing an optional braking system affixed to the hiking bench of the present invention.

An optional safety feature shown in FIGS. 6–8 is a braking system 50 that aids the sailor 19 in controlling the rolling movement of the bench unit 12, 35, or 36. The braking system 50 includes a blocking bar 51 that is linked to a controlling swing arm 52 which is pivotally connected to the underside of the bench 17 at a fixed point 53. A rope 54, or other suitable bar coupling means, acts as a tripline for the braking system 50 in that when the sailor pulls the rope 54, illustrated by the line 55, the blocking bar 51 swings away from engagement with the rollers 15 or 40 so that the bench unit 12 or 35 is allowed to freely roll along the stationary rails to which it is coupled. The rope 54 is preferably held in place by some type of securing device, such as a cleat block 56 such that when it is not used by the sailor 19, the braking system 50 ensures that the rope 54 will not move in such a way that the swing arm 52 will move the blocking bar 51 away from active engagement with the rollers 15 or 40. The braking system 50 preferably is spring–loaded with a spring 57 that ensures the blocking bar 51 remains engaged with the rollers 15 or 40 when the tripline 54 is not activated by the sailor 19.

Figure 9:
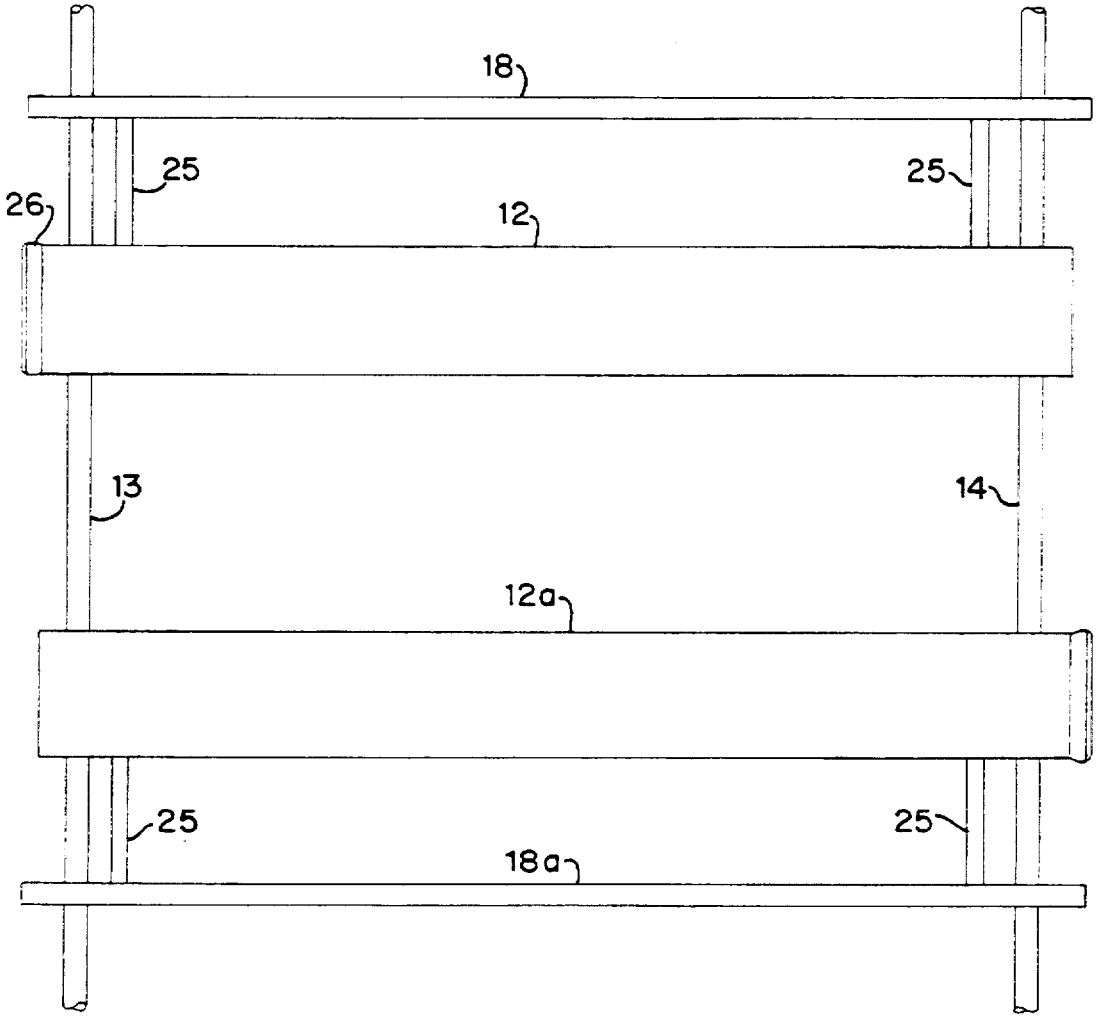
FIG. 9 is a top view showing an alternative design of the hiking bench of the present invention as having a plurality of benches.

As previously noted, the hiking bench system 10 may include a plurality of movable bench units 12. An alternative embodiment of the present invention is shown in FIG. 9 including two bench units 12 and **12*a* coupled to bench rails 13 and 14. The bench units 12 and 12*a* may each be of any of the configurations previously described with respect to FIGS. 1–8, including, but not limited to, the configuration in which the optional braking system 50 forms part of each of the bench units 12 and 12*a***.

Although the present invention has been described with specific reference to detailed embodiments, it is to be understood that alternative embodiments and equivalents are deemed to be within the scope of the invention as defined by the appended claims.

I claim:

1. A device to aid in moving about a watercraft comprising:

a. a bench unit including a bench seat, rolling means affixable to a port side and to a starboard side of an underside of said bench seat, and one or more handrails coupled to said bench seat;

b. a first bench rail affixable to a port gunwale of a watercraft; and c. a second bench rail affixable to a starboard gunwale of the watercraft, wherein said bench unit is movably coupled to and supported by said first bench rail and said second bench rail such that said bench unit may be moved fore and aft on the watercraft and said bench unit extends across at least a substantial portion of a width between said port gunwale, and said starboard gunwale and wherein said rolling means on said port side is rollingly coupled to said first bench rail and said starboard rolling means is rollingly coupled to said second bench rail.

2. The device as claimed in claim 1 further comprising a braking system for halting and permitting movement of said bench unit on said first bench rail and said second bench rail.

3. The device as claimed in claim 2 wherein said bench unit includes a bench seat, said device further comprising rolling means affixable to a port side and to a starboard side of an underside of said bench seat, wherein said rolling means on said port side is rollingly coupled to said first bench rail and said starboard rolling means is rollingly coupled to said second bench rail, and wherein said braking system includes a blocking bar designed to wedge either said port rolling means or said starboard rolling means in place.

4. The device as claimed in claim 3 wherein said braking system further includes a tripline coupled to said blocking bar such that when said tripline is pulled, said blocking bar is disengaged from said rolling means, thereby permitting said bench unit to move freely on said first bench rail and said second bench rail.

5. The device as claimed in claim 1 wherein a plurality of said bench units are coupled to said first bench rail and to said second bench rail.

6. The device as claimed in claim 1 wherein said bench unit is formed with a curvature substantially conforming with an overall curvature of an interior of said watercraft.

7. A device to aid in moving about a watercraft, said device comprising:

a. a bench unit including a bench seat and rolling means affixed to a port side and to a starboard side of an underside of said bench seat;

b. a first bench rail affixable to a port gunwale of a watercraft; and c. a second bench rail affixable to a starboard gunwale of the watercraft, wherein said bench unit is movably coupled to and supported by said first bench rail and said second bench rail such that said bench unit may be moved fore and aft on the watercraft and said bench unit extends across at least a substantial portion of a width between said port gunwale and said starboard gunwale, wherein said rolling means on said port side is rollingly coupled to said first bench rail and said starboard rolling means is rollingly coupled to said second bench rail, and wherein said first bench rail and said second bench rail are each of a length sufficient for said bench unit to be moved thereon approximately from a rear of the watercraft to a mast of the watercraft.

8. A device to aid in moving about a watercraft comprising:

a. a first bench unit;

b. a second bench unit;

c. a port bench rail affixable to a port gunwale of a watercraft and coupled to said first bench unit;

d. a first center rail affixable to a center section of said watercraft and coupled to said first bench unit;

e. a starboard bench rail affixable to a starboard gunwale of said watercraft and coupled to said second bench unit; and f. a second center rail affixable to said center section of said watercraft and coupled to said second bench unit, wherein said first bench unit is movably coupled to said port bench rail and to said first center rail such that said first bench unit may be moved fore and aft on said watercraft, and wherein said second bench unit is movably coupled to said starboard bench rail and to said second center rail such that said second bench unit may be moved fore and aft on said watercraft independent of the movement of said first bench unit.

9. The device as claimed in claim 8 wherein said watercraft is a trimaran and wherein each of said first bench unit and said second bench unit includes a bench seat, said device further comprising rolling means affixable to an outer side and an inner side of an underside of said bench seat, wherein said rolling means on said outer side is rollingly coupled either to said port bench rail or to said starboard bench rail and either to said first center rail or said second center rail, respectively.

10. The device as claimed in claim 9 wherein said bench unit includes one or more handrails coupled to said bench seat.

11. The device as claimed in claim 9 wherein said port bench rail, said starboard bench rail and said first and second center rails are all of a length sufficient for said first bench unit and said second bench unit to be moved thereon approximately from a rear of the trimaran to a mast of the trimaran.

12. The device as claimed in claim 8 further comprising a braking system for halting and permitting movement of said first bench unit on said port bench rail and said first center rail, and said second bench unit on said starboard bench rail and said second center rail.

13. The device as claimed in claim 12 wherein each of said bench units includes an bench seat, said device further comprising rolling means affixable to a outer side and an inner side of an underside of said bench seat, wherein said rolling means on said outer side is rollingly coupled to an outer bench rail that is either said port bench rail or said starboard bench rail and said rolling means on said inner side is rollingly coupled to a center bench rail that is either said first center rail or said second center rail, and wherein said braking system includes a blocking bar designed to wedge either of said rolling means in place.

14. The device as claimed in claim 13 wherein said braking system further includes a tripline coupled to said blocking bar such that when said tripline is pulled, said blocking bar is disengaged from said rolling means.

15. A device to aid in moving about a watercraft comprising:

a. a bench unit, said bench unit including a bench seat and one or more handrails coupled to said bench seat;

b. a first bench rail affixable to a port gunwale of a watercraft;

c. a second bench rail affixable to a starboard gunwale of said watercraft; and d. rolling means affixable to a port side and to a starboard side of an underside of said bench seat, said rolling means on said port side is rollingly coupled to said first bench rail and said rolling means on said starboard side is rollingly coupled to said second bench rail, wherein said bench unit is movably coupled to said first bench rail and to said second bench rail such that said bench unit may be moved fore and aft on said watercraft and both said first bench rail and said second bench rail are of a length sufficient for said bench unit to move thereon approximately from a rear of the watercraft to a mast of the watercraft.

16. The device as claimed in claim 15 further comprising a braking system for halting and permitting movement of said bench unit on said first bench rail and said second bench rail.

17. The device as claimed in claim 16 wherein said bench unit includes a bench seat, said device further comprising rolling means affixable to a port side and to a starboard side of an underside of said bench seat, wherein said rolling means on said port side is rollingly coupled to said first bench rail and said starboard rolling means is rollingly coupled to said second bench rail, and wherein said braking system includes a blocking bar designed to wedge either said port rolling means or said starboard rolling means in place.

18. The device as claimed in claim 15 where in a plurality of said bench units are coupled to said first bench rail and to said second bench rail.

* * * * *